US009435197B2

(12) United States Patent
Duncan

(10) Patent No.: US 9,435,197 B2
(45) Date of Patent: Sep. 6, 2016

(54) DISTRIBUTED MARINIZED BOREHOLE SYSTEM

(71) Applicant: Roger G. Duncan, Christiansburg, VA (US)

(72) Inventor: Roger G. Duncan, Christiansburg, VA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/154,638

(22) Filed: Jan. 14, 2014

(65) Prior Publication Data

US 2015/0198031 A1 Jul. 16, 2015

(51) Int. Cl.

| | |
|---|---|
| ***E21B 47/00*** | (2012.01) |
| ***G01V 3/00*** | (2006.01) |
| ***G01N 29/24*** | (2006.01) |
| ***G01N 29/44*** | (2006.01) |
| ***G01J 3/28*** | (2006.01) |
| ***E21B 7/00*** | (2006.01) |
| ***E21B 47/12*** | (2012.01) |
| ***E21B 33/035*** | (2006.01) |
| ***E21B 7/124*** | (2006.01) |

(52) U.S. Cl.

CPC ..... *E21B 47/123* (2013.01); *E21B 7/124* (2013.01); *E21B 33/0355* (2013.01)

(58) Field of Classification Search

None

See application file for complete search history.

(56) References Cited

U.S. PATENT DOCUMENTS

| | | | | |
|---|---|---|---|---|
| 6,913,079 | B2 * | 7/2005 | Tubel | 166/250.01 |
| 7,261,162 | B2 * | 8/2007 | Deans | E21B 41/0007 166/250.01 |
| 8,354,939 | B2 * | 1/2013 | McDaniel et al. | 340/854.7 |
| 8,408,064 | B2 * | 4/2013 | Hartog | E21B 47/101 73/643 |
| 2007/0039776 | A1 | 2/2007 | Clark | |
| 2008/0217022 | A1 | 9/2008 | Deans | |
| 2009/0114386 | A1 | 5/2009 | Hartog et al. | |
| 2010/0107754 | A1 | 5/2010 | Hartog et al. | |
| 2012/0126992 | A1 * | 5/2012 | Rodney et al. | 340/850 |

OTHER PUBLICATIONS

International Search Report and Written Opinion for PCT Application No. PCT/US2014/069085, dated Apr. 3, 2015, pp. 1-14.

* cited by examiner

*Primary Examiner* — Matthew R Buck
*Assistant Examiner* — Douglas S Wood
(74) *Attorney, Agent, or Firm* — Cantor Colburn LLP

(57) ABSTRACT

A distributed borehole system includes a surface-based assembly located on a surface of a body of water and a marinized assembly located on a floor of the body of water adjacent to a borehole in an earth formation. The system includes a borehole interrogator including a transmitter configured to generate a signal and to transmit the signal into the borehole and a receiver configured to receive a reflected signal from the borehole based on the signal transmitted by the transmitter. The system further includes a processor configured to process the reflected signal to generate data representing characteristics of one of the borehole system, the borehole, and an earth formation defining the borehole. The processor is located in the surface-based assembly, the receiver is located in the marinized assembly, and the transmitter is located in at least one of the surface-based assembly and the marinized assembly.

13 Claims, 4 Drawing Sheets

DISTRIBUTED MARINIZED BOREHOLE SYSTEM

BACKGROUND

The present application relates to underwater borehole systems, and in particular to distributed marinized borehole systems.

Boreholes for extracting oil, gas, or other fluids or mixtures are formed in earth formations by drilling into the earth formation. Drilling mud may used to control conditions in the borehole, and in an underwater borehole environment, pipes typically extend from platforms on a surface of the borehole to the floor of a body of water to transmit the drilling mud to the borehole. Likewise, during and after completion of the borehole, the same or different pipes may be used to transmit fluids, such as drilling mud, hydrocarbons, gas, or any other fluids or mixtures, from the borehole to the platform.

When conditions in the borehole are monitored, the data must be transmitted from sensors at or in the borehole to the processor that processes the data to generate data usable by a system or operator to provide data regarding characteristics in the borehole, to display the data, or to use the data to control operation of a downhole assembly, such as a drilling operation. In some cases, a borehole will be very far from a platform, such as 30 kilometers or more, and transmission of large amounts of data between a marinized assembly and the surface-based platform becomes difficult.

One type of monitoring and data communications system is distributed acoustic sensing (DAS) system. In such a system, a fiber optic wire is inserted into a borehole, a signal is transmitted into the fiber optic wire, and a reflected signal is detected to determine borehole characteristics. In a DAS system, a transmitter typically includes a laser and a pulse modulator and/or frequency modulator to generate the signal to be transmitted into the borehole. The transmitter also includes optics to control characteristics of the light emitted by the laser. A receiver includes one or more optical sensors, optics, and processing circuitry to process the detected reflected signals. However, DAS systems have a limited effective range due to signal losses over extended distances, particularly the distances that may be required to transmit signals between a platform and an undersea borehole.

SUMMARY

According to an embodiment of the invention, a distributed borehole system includes a surface-based assembly located on a surface of a body of water and a marinized assembly located on a floor of the body of water adjacent to a borehole in an earth formation. The system includes a borehole interrogator including a transmitter configured to generate a signal and to transmit the signal into the borehole and a receiver configured to receive a reflected signal from the borehole based on the signal transmitted by the transmitter. The system further includes a processor configured to process the reflected signal to generate data representing characteristics of one of the borehole system, the borehole, and an earth formation defining the borehole. The processor is located in the surface-based assembly, the receiver is located in the marinized assembly, and the transmitter is located in at least one of the surface-based assembly and the marinized assembly According to another embodiment of the invention, a method of monitoring a distributed borehole system includes generating, by a transmitter of an interrogator, a laser beam and transmitting the laser beam into a borehole. The method includes receiving, by a receiver of the interrogator, reflected light from the borehole and converting reflected light into an electronic signal, the receiver located on a floor of a body of water and transmitting the electronic signal to a processor located on a platform on a surface of the body of water. The method further includes processing the electronic signal, by the processor located on the platform, to analyze characteristics of the borehole.

According to another embodiment of the invention, a method of fabricating a distributed borehole system includes fabricating a surface-based assembly on a surface of a body of water and fabricating a marinized assembly on a floor of the body of water adjacent to a borehole in an earth formation. The method includes providing in at least one of the surface-based assembly and the marinized assembly a borehole interrogator including a transmitter configured to generate a signal and to transmit the signal into the borehole and a receiver configured to receive a reflected signal from the borehole based on the signal transmitted by the transmitter, the receiver being located in the marinized assembly. The method also includes providing in the surface-based assembly a processor configured to process the reflected signal to generate data representing characteristics of one of the borehole system, the borehole, and an earth formation defining the borehole.

BRIEF DESCRIPTION OF THE DRAWINGS

Referring now to the drawings wherein like elements are numbered alike in the several Figures.

DETAILED DESCRIPTION

Undersea wells require fluids and electronic signals to be transmitted between platforms on a surface of the sea and the wellbore located in the sea floor. Signals transmitted over long distances that may exist along the transmission lines between the platforms and the wellbore may be subject to losses. Embodiments of the invention relate to a distributed borehole system including processing circuitry in a surface-based platform and a receiver in a marinized assembly.

Figure 1:
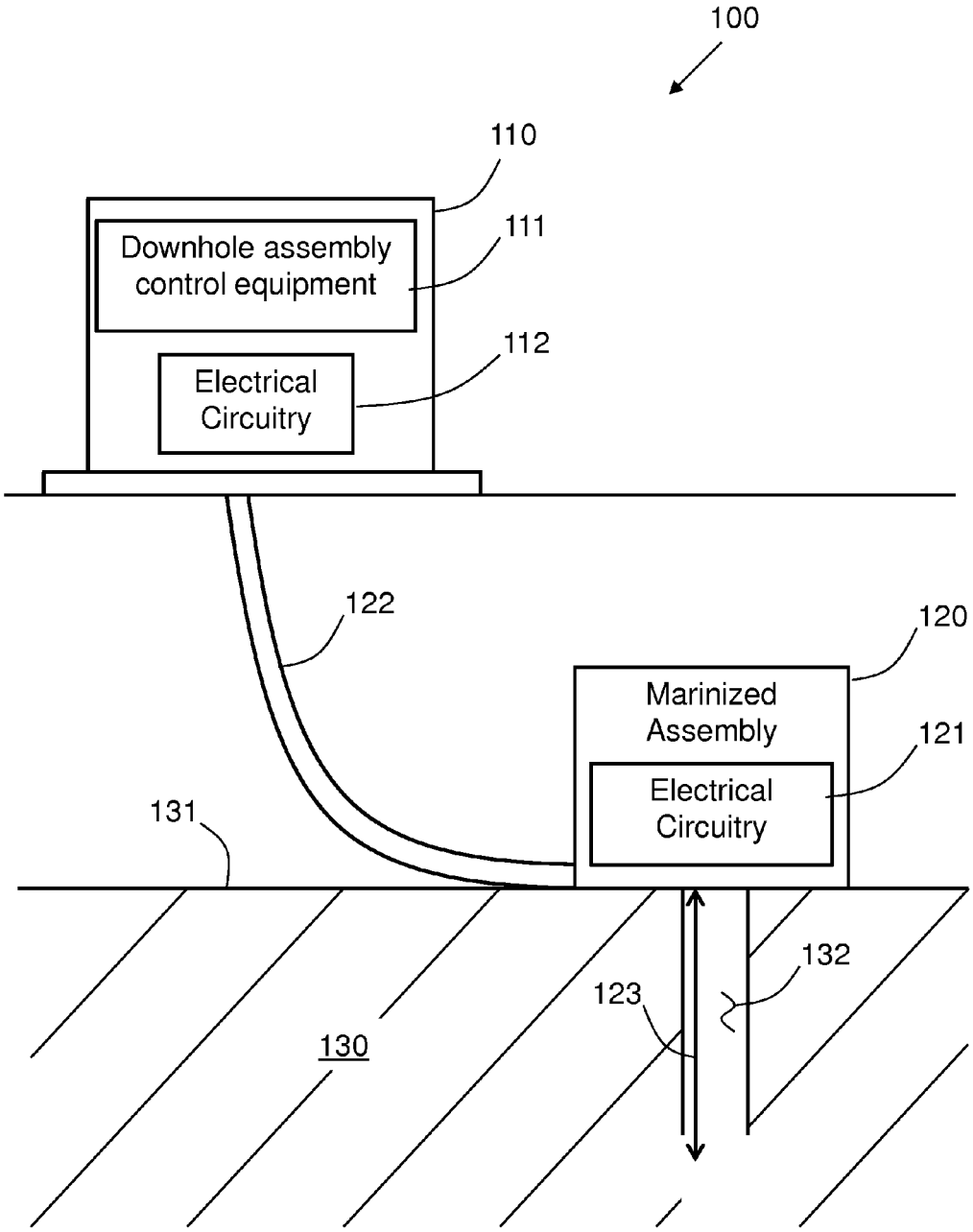
FIG. 1 illustrates a distributed borehole system according to an embodiment of the invention.

FIG. 1 illustrates a wellbore system 100 according to an embodiment of the invention. The system 100 includes a surface-based assembly 100 on the surface of a body of water 140 and a marinized assembly 120 connected by transmission lines 122. A borehole 132 is formed in an earth formation 130, and the marinized assembly 120 is located on a floor 131 of the body of water 140. In the present description and claims, a marinized assembly is defined as an assembly adapted to operate in an under-water environment, and in particular in an oceanic or undersea environment.

In one embodiment, the surface-based assembly 110 is a well-drilling platform and the marinized assembly 120 includes a well-drilling derrick. In another embodiment, the surface-based assembly 100 is a platform for performing other operations on the borehole 132, such as an oil or gas extraction platform, a well completion platform, or any other type of platform. Likewise, the marinized assembly 120 may include a wellhead, derrick, or other equipment for drilling a borehole and extracting oil or gas from the borehole.

In embodiments of the invention, the surface-based assembly 110 includes borehole assembly control equipment 111. For example, the borehole assembly control equipment 111 may include mechanical components to control the flow of fluids to and/or from the wellbore 132 and electrical components for controlling pumps, motors, and other systems for drilling or oil/gas extraction. The transmission lines 122 include piping for transmitting fluids and conductive lines for transmitting power and data. The surface-based assembly 110 also includes electrical circuitry 112, and the marinized assembly 120 also includes electrical circuitry 121. In embodiments of the invention, the electrical circuitry 112 in the surface-based assembly 110 includes a processor for processing data obtained from inside the borehole 132. In addition, the combination of the electrical circuitry 112 and 121 include wellbore-assembly monitoring circuitry. The wellbore-assembly monitoring circuitry may include an interrogator including a transmitter which generates a laser beam and transmits the laser beam into the borehole 132 via an optical fiber 123, a receiver which receives reflected light from the optical fiber 123 and converts the reflected light into electrical signals, and a processor which processes the electrical signals to generate data about the borehole 132, a borehole assembly (such as drill string, oil/gas extraction piping, etc.), or the earth formation 130.

In embodiments of the invention, the interrogator is distributed between the electrical circuitry 112 located in the surface-based assembly 110 and the electrical circuitry 121 located in the marinized assembly 120. In particular, primarily active processing components are located in the surface-based assembly 110 and primarily passive processing components are located in the marinized assembly 120. In one embodiment, the processor of the interrogator which processes electrical signals based on received reflected light is located in the surface-based assembly 110 and the receiver of the interrogator is located in the marinized assembly 120.

In one embodiment of the invention, the system 100 is a distributed acoustic sensing (DAS) system. In such an embodiment, the surface-based assembly 110 is a platform, and one of the electrical circuitry 112 on the platform or the electrical circuitry 121 in the marinized assembly 120 includes a transmitter. The transmitter includes a laser and modulating circuitry to generate a signal. The optical fiber 123 receives the signal emitted from the electrical circuitry 112 or 121. The electrical circuitry 121 in the marinized assembly 120 receives a reflected signal from the optical fiber 123 and converts the signal from an optical signal into an electrical signal, such as a digital or analog electrical signal. The marinized assembly 120 includes a modem that transmits the electrical signal to the platform, and the electrical circuitry 112 of the platform 110 includes a processor that processes the electrical signal to generate borehole data, such as by analyzing or categorizing the data, performing signal processing, converting the data to graphical data that can be used to generate a display, such as a three-dimensional picture of the borehole 132 or formation 132, or any other processing of the electrical signal. In other words, in one embodiment, optical signals are used to detect borehole characteristics, but the optical signals are not transmitted from the marinized assembly to the surface-based assembly. Instead, the reflected optical signals are converted to electrical signals in a marinized assembly and transmitted to an above-water platform for further processing, storage, and transmission.

Figure 2:
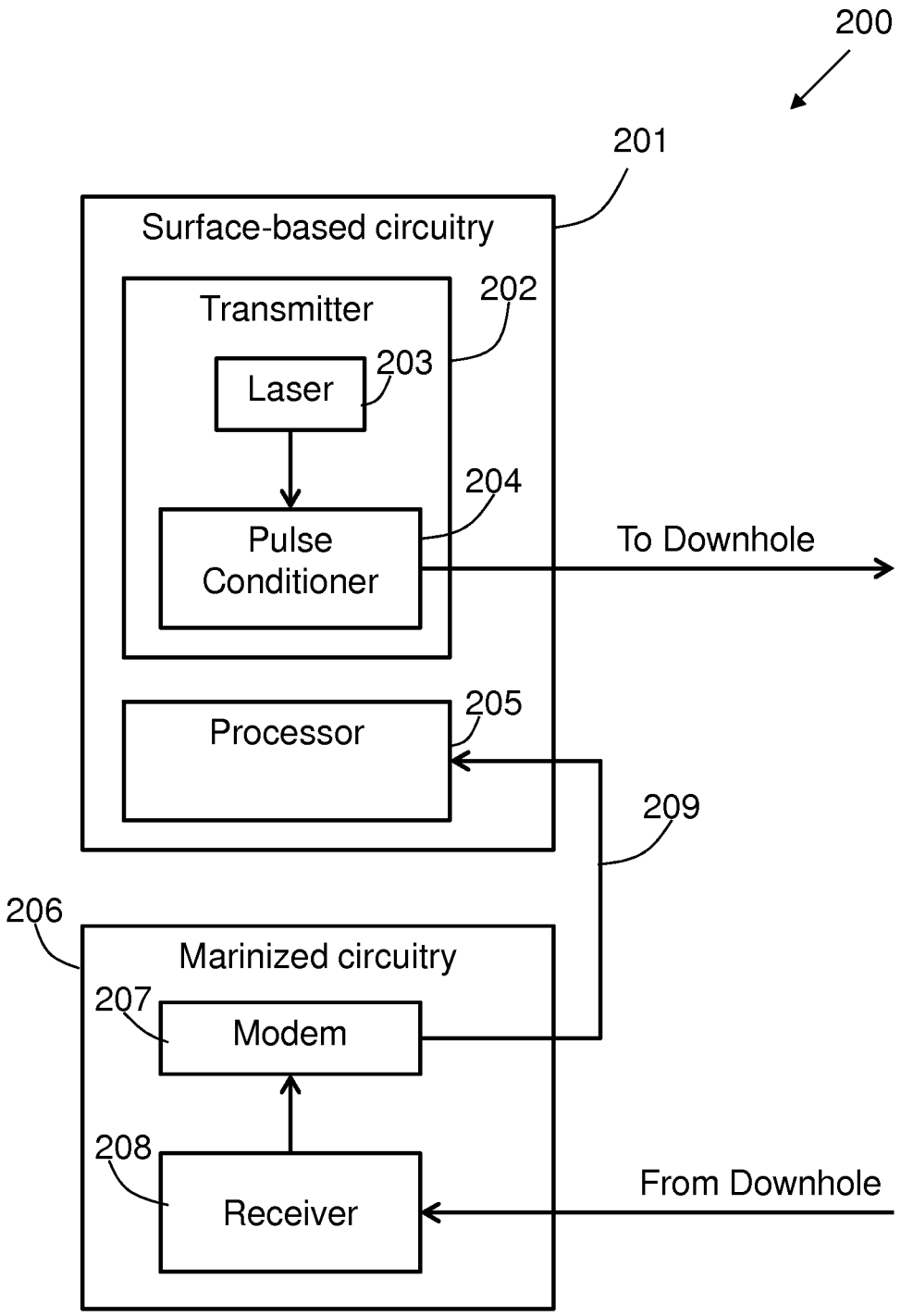
FIG. 2 illustrates a block diagram of wellbore-assembly monitoring circuitry according to an embodiment of the invention.

FIG. 2 illustrates an arrangement of wellbore-assembly monitoring circuitry 200 according to one embodiment of the invention. The wellbore-assembly-monitoring circuitry 200 includes surface-based circuitry 201 located at the surface of a body of water and marinized circuitry 206 located on a floor of the body of water. The surface-based circuitry 201 includes a transmitter 202 including a laser 203 and a pulse conditioner 204. The surface-based circuitry 201 also includes a processor 205. The marinized circuitry 206 includes a receiver 208 and a modem 207. The laser 203 is configured to generate a laser beam, or a beam of coherent light, and the pulse conditioner 204 is configured to modulate or otherwise alter the laser beam in predetermined patterns, such as by altering pulse widths of the laser beam, and to transmit the laser beam downhole into a borehole.

Although the pulse conditioner 204 is illustrated as being downstream of the laser 203, embodiments of the invention encompass circuitry for altering the laser beam upstream of the laser 203, such as a pulse conditioner, a frequency generator, or any other circuitry for controlling the laser 203.

The receiver 208 is configured to receive a reflected signal from the borehole, such as reflected light from the laser beam. The receiver 208 may include passive optics, such as lenses, mirrors, refractors, or any other passive optics, and sensors for sensing an intensity of the reflected light, a frequency of the reflected light, or any other characteristic of the reflected light. The receiver 208 may include conversion circuitry for converting optical signals into electrical signals, and a modem 207 for converting the electrical signals into a data transmission format, such as by dividing the data into data packets, or performing any other data transmission functions on the electrical signals.

The modem 207 transmits the data based on the electrical signals, which was in turn based on the reflected light, to the processor 205 in the surface-based circuitry 205, where the data is processed. The modem 207 transmits the data via a transmission line 209 extending through a body of water between the surface-based circuitry 201 and the marinized circuitry 206. In embodiments of the invention, processing the data includes converting raw data into a format for analyzing characteristics of the borehole, of the borehole assembly, or of an earth formation defining the borehole. Accordingly, processing the data includes binning the data into predetermined increments based on time, depth, intensity, or any other criteria; amplifying the data; generating display data which can be transmitted to a display device to provide a display to a user representing characteristics of the borehole in a graphical format; performing error-correction on the data; or performing any other processing of raw data to represent characteristics of the borehole.

In embodiments of the invention, the conversion of the optical signals into electronic signals, and the conversion of the electronic signals into transmittable data are processes that require less processing, such as requiring less bandwidth and involving less intensive and less complex data processing algorithms than the data processing of the processor 205 that converts the transmitted data into data that represents characteristics of the borehole, borehole assembly, or earth formation. In one embodiment, the surface-based circuitry 201 generates more heat, requires greater processing bandwidth, requires more processing power, includes more complex data processing algorithms, and requires more complex processors than the marinized circuitry 206. In one embodiment, the processor 205 generates more data, or data requiring more memory to store, than the receiver 208 and modem 207. Accordingly, providing the receiver 208 and modem 207 in the marinized circuitry 206 and the transmitter 202 and processor 205 in the surface-based circuitry 201 requires the transmission of less data through the transmission line 209 than if the processor 205 were located in the marinized circuitry 206.

Figure 3:
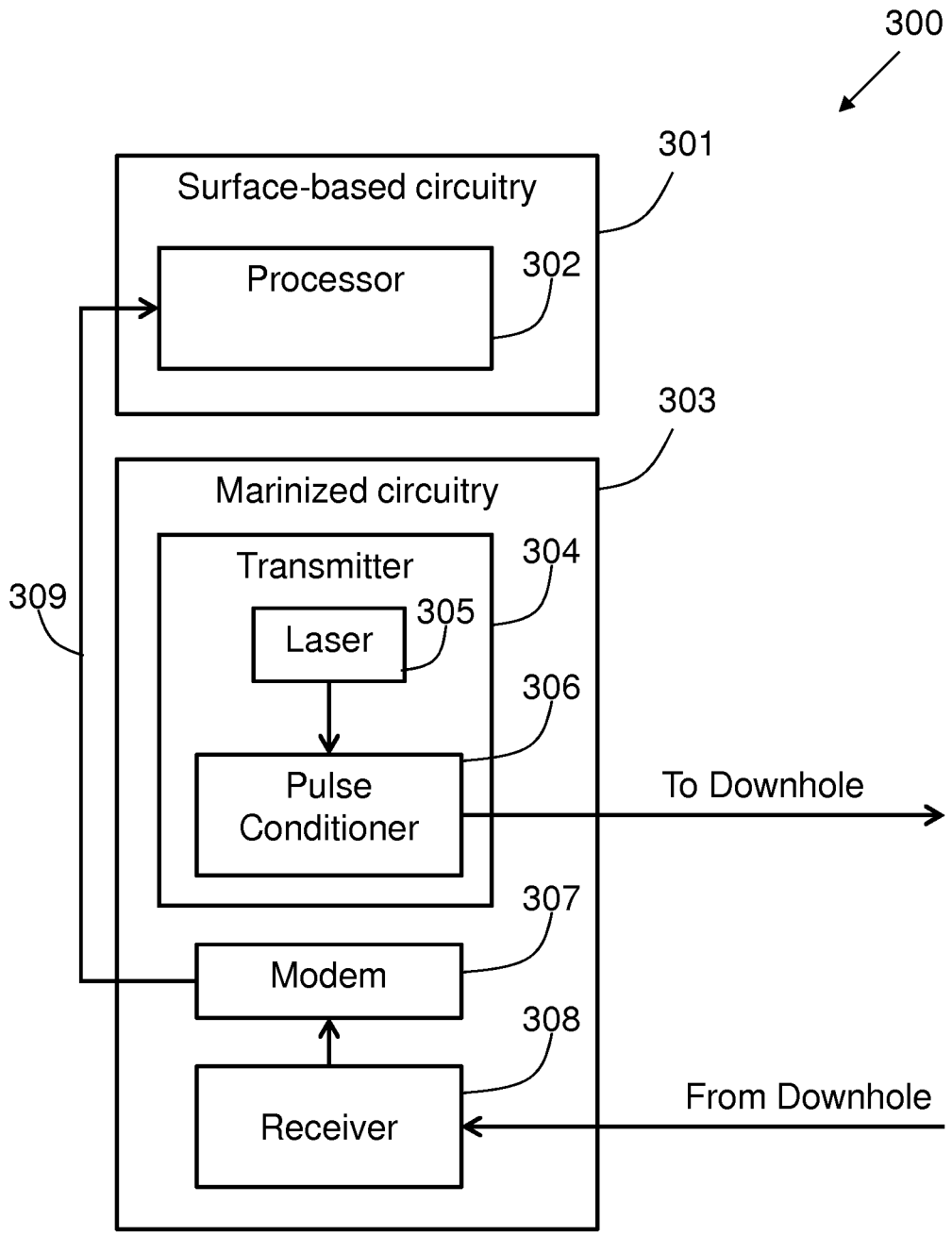
FIG. 3 illustrates a block diagram of wellbore-assembly monitoring circuitry according to an embodiment of the invention.

FIG. 3 is similar to FIG. 2, except the transmitter 304 is located in the marinized circuitry 303 instead of the surface-based circuitry 303. The wellbore-assembly-monitoring circuitry 300 includes surface-based circuitry 301 located at the surface of a body of water and marinized circuitry 303 located on a floor of the body of water. The surface-based circuitry 301 includes a processor 302, and the marinized circuitry 303 includes a transmitter 304, including laser 305 and pulse conditioner 306, a receiver 308, and a modem 307. The laser 305 is configured to generate a laser beam, or a beam of coherent light, and the pulse conditioner 306 is configured to modulate or otherwise alter the laser beam in predetermined patterns, such as by altering pulse widths of the laser beam, and to transmit the laser beam downhole into a borehole.

The receiver 308 is configured to receive a reflected signal from the borehole, such as reflected light from the laser beam. The receiver 308 may include passive optics, such as lenses, mirrors, refractors, or any other passive optics, and sensors for sensing an intensity of the reflected light, a frequency of the reflected light, or any other characteristic of the reflected light. The receiver 308 may include conversion circuitry for converting optical signals into electrical signals, and a modem 307 for converting the electrical signals into a data transmission format, such as by dividing the data into data packets, or performing any other data transmission functions on the electrical signals.

The modem 307 transmits the data based on the electrical signals, which was in turn based on the reflected light, to the processor 302 in the surface-based circuitry 301, where the data is processed. The modem 307 transmits the data via a transmission line 309 extending through a body of water between the surface-based circuitry 301 and the marinized circuitry 303.

While embodiments of the invention have been described with respect to the transmission of a laser beam into a borehole and detecting reflected light from the laser beam, embodiments encompass any borehole system including a surface-based platform on a surface of a body of water and an marinized assembly on a floor of the body of water, in which a signal is transmitted into a borehole and a reflected signal is detected based on the transmitted signal. Embodiments of the invention further encompass any system in which data is gathered from monitoring equipment in a borehole at the bottom of a body of water, signal transmission or reception is performed by a marinized assembly in the body of water, and in particular, close to the borehole, and the data is transmitted to a surface-based platform on a surface of a body of water.

Figure 4:
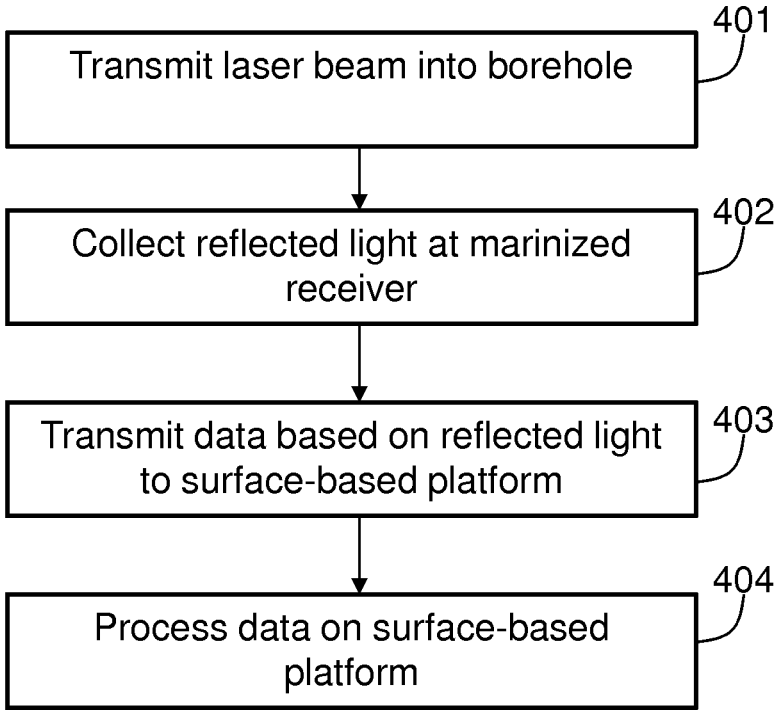
FIG. 4 is a flow diagram representing a method of monitoring a distributed borehole system according to an embodiment of the invention.

FIG. 4 is a flowchart illustrating a method of monitoring a borehole in a distributed borehole system according to one embodiment of the invention. In block 401, a laser beam is generated and transmitted into a borehole. In one embodiment, the laser beam is generated and transmitted by a transmitter located in a surface-based platform on a surface of a body of water. In another embodiment, the laser beam is generated and transmitted by a transmitter located in an marinized assembly located on a floor of the body of water.

In block 402, reflected light is received from the borehole corresponding to the light from the laser beam transmitted into the borehole. In embodiments of the invention, the receiver is located in the marinized assembly located on the floor of the body of water. In one embodiment, the receiver is configured to convert the reflected light, or another signal output from the borehole, into an electrical signal. In one embodiment, the receiver includes a modem to convert the electrical signal into transmission data that may be transmitted between the marinized assembly and the surface-based platform.

In block 403, transmission data is transmitted to the surface-based platform. In block 404, the transmission data is processed to generate borehole representation data, or data that characterizes or describes characteristics in the borehole. The processed data is transformed from the transmission data to be used by a borehole analysis system. For example, the data may be organized, categorized, binned, transformed into display data, or converted to the borehole representation data by any other means. In embodiments of the invention, the processor that converts the transmission data into borehole representation data is located in the surface-based platform.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A distributed borehole system, comprising:

a surface-based assembly located on a surface of a body of water; and a marinized assembly located on a floor of the body of water adjacent to a borehole in an earth formation;

a borehole interrogator including a transmitter configured to generate a signal and to transmit the signal into the borehole and a receiver configured to receive a reflected signal from the borehole based on the signal transmitted by the transmitter and convert the reflected signal into an electronic signal; and a processor configured to process the electronic signal representing the reflected signal to generate data representing characteristics of one or more of the borehole system, the borehole, and an earth formation defining the borehole, wherein the processor is located in the surface-based assembly, the receiver is located in the marinized assembly, and the transmitter is located in at least one of the surface-based assembly and the marinized assembly.

2. The distributed wellbore system of claim 1, wherein the system is a distributed acoustic sensing (DAS) system, the transmitter includes a laser and a pulse conditioner, the pulse conditioner configured to modulate a laser beam generated by the laser, and the transmitter configured to transmit a modulated laser beam into the wellbore, and the receiver receives light reflected from the borehole based on the modulated laser beam and converts the light reflected from the borehole into the electronic signal.

3. The distributed wellbore system of claim 2, wherein the transmitter is located in the marinized assembly.

4. The distributed wellbore system of claim 2, wherein the transmitter is located in the surface-based assembly.

5. The distributed wellbore system of claim 1, wherein the marinized assembly includes downhole assembly control equipment for controlling operation of a downhole assembly in the borehole.

6. The distributed wellbore system of claim 1, wherein the marinized assembly includes passive optical components of the interrogator, and the surface-based assembly includes active processing components of the interrogator.

7. A method of monitoring a distributed borehole system, comprising:

generating, by a transmitter of an interrogator, a laser beam;

transmitting the laser beam into a borehole;

receiving, by a receiver of the interrogator, reflected light from the borehole and converting reflected light into an electronic signal, the receiver located on a floor of a body of water;

transmitting the electronic signal to a processor located on a platform on a surface of the body of water; and processing the electronic signal representing the reflected light, by the processor located on the platform, to analyze characteristics of the borehole.

8. The method of claim 7, wherein the transmitter is located on the platform on the surface of the body of water, the method comprising:

transmitting the laser beam from the platform to the borehole.

9. The method of claim 7, wherein the transmitter is located in a marinized assembly locate on the floor of the body of water adjacent to the borehole.

10. A method of fabricating a distributed borehole system, comprising:

fabricating a surface-based assembly on a surface of a body of water;

fabricating a marinized assembly on a floor of the body of water adjacent to a borehole in an earth formation;

providing in at least one of the surface-based assembly and the marinized assembly a borehole interrogator including a transmitter configured to generate a signal and to transmit the signal into the borehole and a receiver configured to receive a reflected signal from the borehole based on the signal transmitted by the transmitter and convert the reflected signal into an electronic signal, the receiver located in the marinized assembly; and providing in the surface-based assembly a processor configured to process the electronic signal representing the reflected signal to generate data representing characteristics of one of the borehole system, the borehole, and an earth formation defining the borehole.

11. The method of claim 10, wherein providing the borehole interrogator in at least one of the surface-based assembly and the marinized assembly includes providing the transmitter in the surface-based assembly.

12. The method of claim 10, wherein providing the borehole interrogator in at least one of the surface-based assembly and the marinized assembly includes providing the transmitter in the marinized assembly.

13. The method of claim 10, wherein providing the borehole interrogator in at least one of the surface-based assembly and the marinized assembly includes providing passive optical components in the marinized assembly and providing active processing components in the surface-based assembly.

* * * * *